US011993420B2

(12) United States Patent
Helle et al.

(10) Patent No.: US 11,993,420 B2
(45) Date of Patent: May 28, 2024

(54) STORAGE AND DISPLAY ASSEMBLY FOR A PERSONAL CARE PRODUCT

(71) Applicant: The Gillette Company LLC, Boston, MA (US)

(72) Inventors: Matthew James Helle, Cambridge, MA (US); Sharika D. Anderson, Boston, MA (US); Jiong Hui Li, Quincy, MA (US); Brian Patrick Watson, Marshfield, MA (US); David John Haylings, Great Bookham (GB); Artur Wichowski, Lohn-Ammannsegg (CH); Bingxiao Wang, Dongguan (CN)

(73) Assignee: The Gillette Company LLC, Boston, MA (US)

( * ) Notice: Subject to any disclaimer, the term of this patent is extended or adjusted under 35 U.S.C. 154(b) by 226 days.

(21) Appl. No.: 17/502,717

(22) Filed: Oct. 15, 2021

(65) Prior Publication Data

US 2023/0086013 A1 Mar. 23, 2023

(51) Int. Cl.

| | |
|---|---|
| ***B65D 25/22*** | (2006.01) |
| ***B65B 5/04*** | (2006.01) |
| ***B65B 7/28*** | (2006.01) |
| ***B65D 43/02*** | (2006.01) |

(52) U.S. Cl.

CPC ..... *B65D 25/22* (2013.01); *B65B 5/04* (2013.01); *B65B 7/28* (2013.01); *B65D 43/0202* (2013.01); *B65D 2543/00194* (2013.01)

(58) Field of Classification Search

CPC . Y10S 206/806; Y10S 206/807; B65D 33/14; B65D 73/0071; B65D 73/0064; B65D 75/56; B65D 2211/00; B65D 25/22; B65D 5/4208; B65B 5/04; B65B 7/28

USPC ..... 220/751, 481, 212.5; 206/806, 807, 461, 206/1.5

See application file for complete search history.

(56) References Cited

U.S. PATENT DOCUMENTS

| | | | | |
|---|---|---|---|---|
| 3,206,012 | A | 9/1965 | Braginetz | |
| D259,596 | S | 6/1981 | Gray | |
| D261,950 | S | 11/1981 | Jankowski | |
| D262,585 | S | 1/1982 | Anema | |
| 4,349,102 | A * | 9/1982 | Strongwater | B65D 25/22 206/45.24 |
| D313,175 | S | 12/1990 | Motta et al. | |
| 5,257,704 | A * | 11/1993 | Gutt | G09F 3/0341 206/385 |

(Continued)

FOREIGN PATENT DOCUMENTS

| | | |
|---|---|---|
| FR | 2737189 A1 | 1/1997 |
| WO | 2007119045 A2 | 10/2007 |

OTHER PUBLICATIONS

PCT Search Report and Written Opinion for PCT/CN2021/119299 dated Feb. 23, 2022, 11 pages.

(Continued)

*Primary Examiner* — King M Chu
(74) *Attorney, Agent, or Firm* — John M. Lipchitz

(57) ABSTRACT

A storage and display assembly with a base defining a cavity configured to receive a product. A lid is mounted to the base covering the cavity. A hang tag is mounted to the base. The hang tag has a first position with a first end of the hang tag engaging an inner surface of the lid securing the lid to the base and a second position with the first end of the hang tag is disengaged from the inner surface of the lid.

17 Claims, 5 Drawing Sheets

(56) References Cited

U.S. PATENT DOCUMENTS

| | | | | |
|---|---|---|---|---|
| D501,955 | S | 2/2005 | Long et al. | |
| 6,896,137 | B2 | 5/2005 | Mchutchinson | |
| 6,905,024 | B1 * | 6/2005 | Cao | A47F 7/024 70/57.1 |
| D596,953 | S | 7/2009 | Wonderley et al. | |
| 8,955,671 | B1 * | 2/2015 | Barnett | B65D 11/12 206/806 |
| D745,775 | S | 12/2015 | Provost et al. | |
| D846,264 | S | 4/2019 | Wu | |
| D883,802 | S | 5/2020 | Meech et al. | |
| D895,268 | S | 9/2020 | Goeder | |
| D895,960 | S | 9/2020 | Goeder | |
| D908,960 | S | 1/2021 | Ramm et al. | |
| 2003/0101525 | A1 | 6/2003 | Belloli | |
| 2003/0209457 | A1 | 11/2003 | Coffin et al. | |
| 2005/0218033 | A1 | 10/2005 | Curtis | |
| 2011/0119923 | A1 | 5/2011 | Nicoll et al. | |
| 2015/0047481 | A1 | 2/2015 | Nicoll et al. | |
| 2015/0059197 | A1 | 3/2015 | Sassano | |
| 2018/0079581 | A1 | 3/2018 | Marquette | |
| 2018/0160790 | A1 | 6/2018 | Swatty et al. | |
| 2021/0259384 | A1 | 8/2021 | Mcgarry et al. | |

OTHER PUBLICATIONS

All Office Actions; U.S. Appl. No. 29/738,123, filed Jun. 15, 2020.

* cited by examiner

STORAGE AND DISPLAY ASSEMBLY FOR A PERSONAL CARE PRODUCT

FIELD OF THE INVENTION

The present invention generally relates to storage and display assemblies for personal care products, and more particularly to a storage case having a hang tag to facilitate displaying and secure one or more components of a shaving razor system.

BACKGROUND OF THE INVENTION

Consumer products are incorporating more innovation to provide consumers with improved user experiences. However, innovative consumer products are more expensive and thus are more likely to be stolen at the retail shelf by shoplifters. Shoplifters typically look for products that are compact, relatively expensive and can be sold for near-retail prices. For example, razors and razor blade cartridges are typically expensive, small in size, have a high resale value and are in high demand, especially for more premium brands. Similar to razors and razor blades, electric toothbrushes and their corresponding replacement heads are also commonly shoplifted items. Teeth whitening strips are another dental hygiene product with a high theft rate in retail stores. Furthermore, with the advancement of e-commerce the shoplifting industry is growing because of the increased ease of selling of stolen products over the internet.

Consumer product companies and retailers typically used plastic blister packages because they are more difficult for shoplifters to tear open. However, due to mounting global concerns about the environment, it has become desired for producers to adopt eco-friendly packaging. Plastic packages also frustrate legitimate consumers because of the difficulty of opening the package without the aid of a sharp tool. Accordingly, more packages are being designed with paper based materials. However, paper based packages are easier to rip open, especially when anti-theft tags are attached to the hang tag portion of the package. Despite the use of known packaging techniques, there remains a need to further modify consumer product packages to hamper product theft while also providing a more sustainable package.

It would be desirable to provide durable, multi-use packaging for a shaving razor system that could be used both to securely display the product in a retail environment and store the product during consumer use.

SUMMARY OF THE INVENTION

In one aspect, the invention features, in general, a storage and display assembly with a base defining a cavity configured to receive a product. A lid is mounted to the base covering the cavity. A hang tag is mounted to the base. The hang tag has a first position with a first end of the hang tag engaging an inner surface of the lid securing the lid to the base and a second position with the first end of the hang tag is disengaged from the inner surface of the lid.

In another aspect, the invention features, in general a storage and display assembly having a base defining a cavity. A product is positioned within the cavity. A lid is mounted to the base covering the cavity. A hang tag is pivotally mounted to the base. The hang tag has a first position locking the lid to the base and a second position allowing the lid to be removed from the base.

In another aspect, the invention features, in general a method of assembling a storage and display assembly by providing a base defining a cavity. A hang tag is pivotably attached to the base. A consumer product is positioned within the cavity. A lid is mounted over the base covering a portion of the hang tag within the lid. The method may optionally include pivoting the hang tag to a first position, such the lid engages with a hook at a first end of the hang tag. The method may also optionally include locking the hang tag in the first position by securing a security tag to the hang tag.

DETAILED DESCRIPTION OF THE INVENTION

Figure 1:
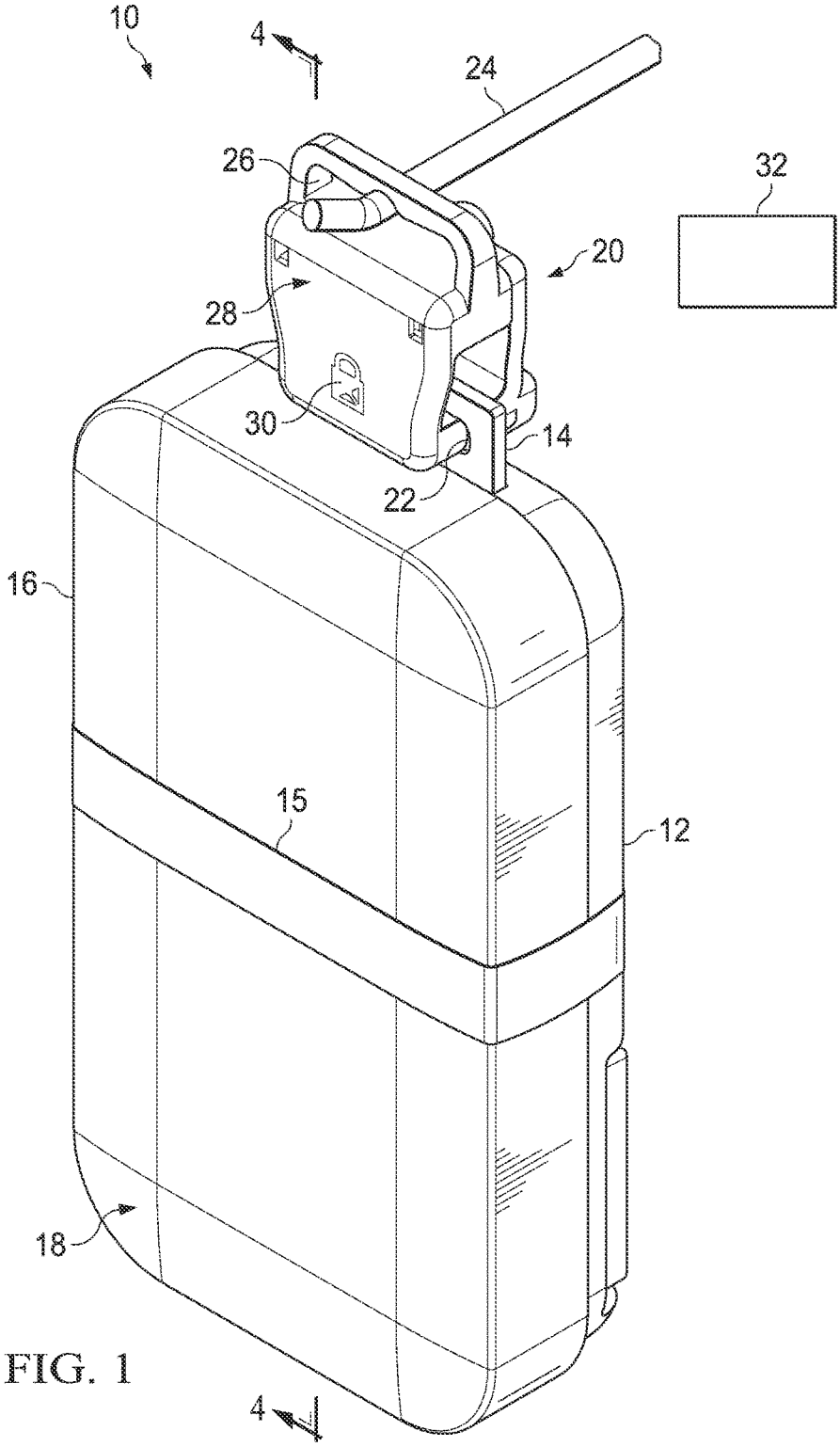
FIG. 1 is a perspective view of one possible embodiment of a storage and display assembly in a retail environment.

Referring to FIG. 1 is a perspective view of one possible embodiment of a storage and display assembly 10 is illustrated in a retail environment. The storage and display assembly 10 may include a base 12, a hang tag 14 and a lid 16 mounted over the bae 12 and a portion of the hang tag 14. The lid 16 may have a front face 18 that may include branding and other information related to the contents of the storage and display assembly 10. In certain embodiments, a sleeve 15 may be wrapped around a portion of the base 12 and the lid 16. In certain embodiments, the sleeve 15 may be wrapped around the lid 16 and the base 12. The sleeve 15 may have a temporary adhesive to secure the sleeve 15 to the base 12 and/or the lid 16. The sleeve 15 may be removed and discarded after purchasing the storage and display assembly 10. The base 12 and the lid 16 may each comprise a durable material such as an engineering plastic, such as polycarbonate and/or a metal, or a metal alloy, such as steel, aluminum, tin, or combinations thereof. The storage and display assembly 10 may provide a sturdy, multi-use container that protects any consumer goods (not shown) stored within the storage and display assembly 10. The material of the base 12 and the lid 16 may not only make it more difficult for a potential thief to break into, but it may serve as a convenient travel case that can be reused, unlike typical plastic blister packs or paperboard consumer good packages that are thrown away after opening.

A security tag 20 may be temporarily fixed to the hang tag 14 to provide for anti-theft functionality. The hang tag 14 may define an opening 22 dimensioned to receive a retail peg 24. Alternatively, the security tag 20 may be secured to hang tag 14 utilizing the opening 22, as shown in FIG. 1. The security tag 20 may define an opening 26 dimensioned to receive the retail peg 24. However, it is understood that the storage and display assembly 10 with the security tag 20 may also be displayed on a shelf instead of hanging from the retail peg 24. The security tag 20 may have a body 28 and a sensor 30 that are external of the storage and display assembly 10. The security tag 20 and/or the sensor 30 may extend beyond the storage and display assembly 10 to be clearly visible to a consumer or a potential shoplifter. The positioning of the security tag 20 external of the storage and display assembly 10 and clearly visible, may further deter shoplifters from stealing the storage and display assembly 10. For example, if potential shoplifters are aware a product has an anti-theft device, then they are less likely to try to steal it. The sensor 30 may be in communication with a store alarm system 32. Accordingly, if the security tag 20 is not removed from the storage and display assembly 10 prior to leaving the store, the sensor 30 may trigger the alarm system 32, notifying store personnel. The security tag 20 may be removed by store personnel at checkout and reused for other storage and display assemblies 10.

Figure 2:
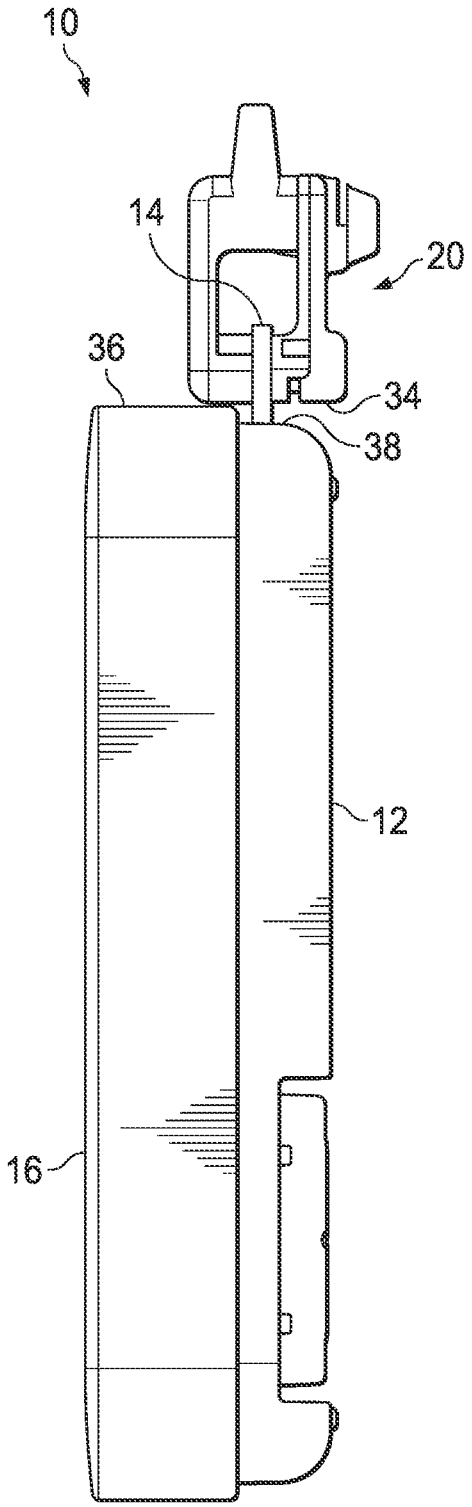
FIG. 2 is side view of the storage and display assembly with a security tag.

Referring to FIG. 2, side view of the storage and display assembly 10 with the security tag 20 attached to the hang tag 14. As will be explained in greater detail below, the hang tag 14 may pivot between a first position and a second position. In the first position, the hang tag 14 may maintain the lid 16 secured to the base 12. The security tag 20 may have a bottom surface 34 that contacts a top surface 36 of the lid 14 and/or a top surface 38 of the base 14 to prevent the hang tag 14 from moving out of the first position, thus keeping the lid 16 secured to the base 12 while the storage and display assembly 10 is within a retail environment prior to purchase.

Figure 3:
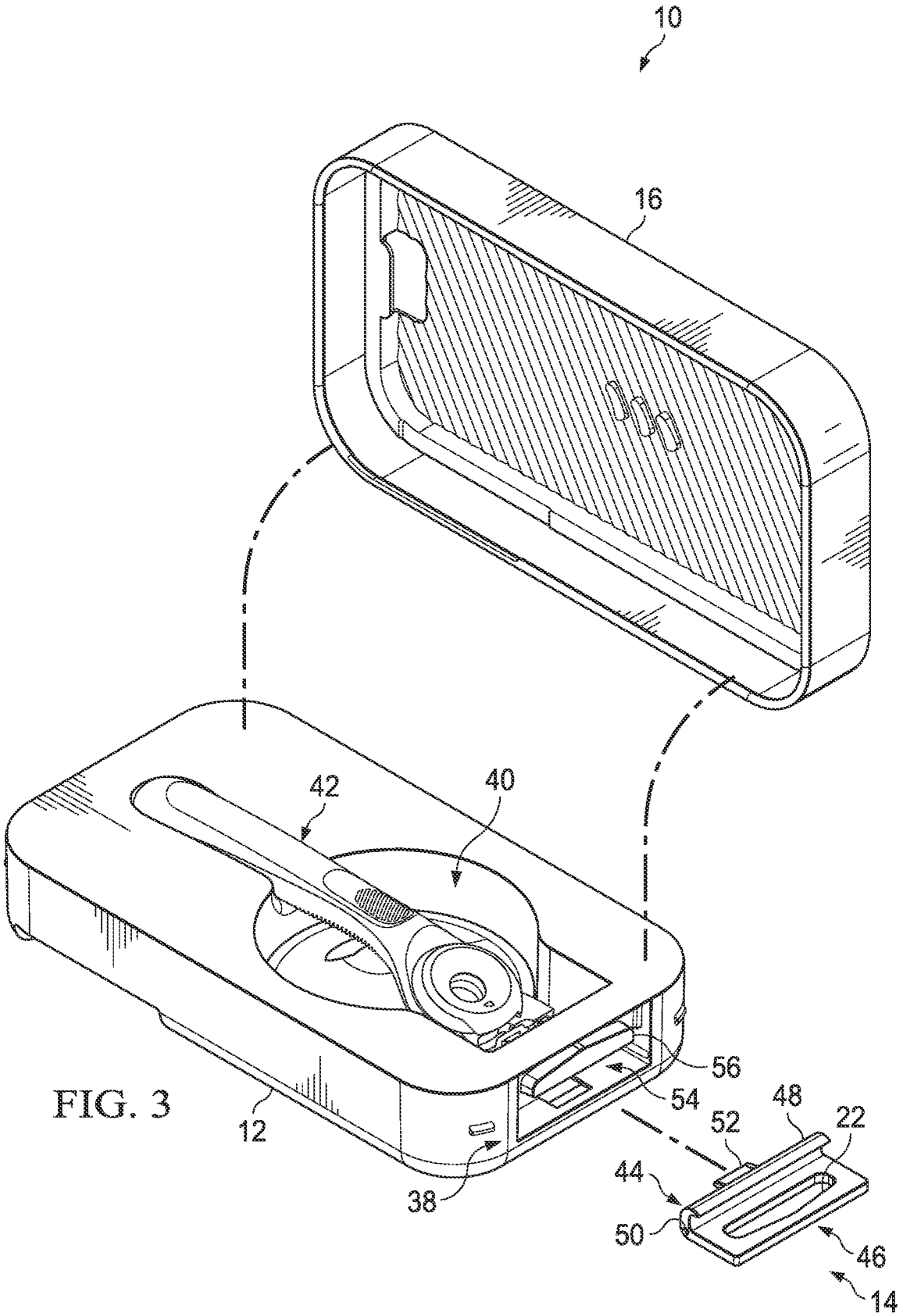
FIG. 3 is an assembly view of the storage and display assembly of FIG. 1.

Referring to FIG. 3, an assembly view of the storage and display assembly 10 is illustrated. The base 12 may define a cavity 40 configured to receive a consumer product 42. Although the consumer product 42 illustrated is a shaving razor, it is understood that the storage and display assembly 10 may store other products, including, but not limited to tooth brushes and electric razors. The hang tag 14 may have a first end 44 and a second end 46. The first end 44 may include a hook 48 that engages the lid 16 in the first position. The first end 44 may have a pin 50 to facilitate the hang tag 14 to pivot between the first position and the second position. A tab 52 may extend from the first end 44 (e.g., the hook 48) to facilitate engagement of the lid 16. The base 12 (e.g., the top surface 38) may define a recess 54 dimensioned to receive the hang tag 14. A protrusion 56 may be positioned within the recess 54. As will be described in greater detail below, the opening 22 of the hang tag 14 may be dimensioned to receive the hang tag 14 in the second position. Before or after the consumer product 42 is positioned within the cavity 40, the first end 44 may be inserted into the recess 54. The lid 16 may then be mounted over the base 12. Once the lid 16 is mounted over the base 12, the hang tag 14 may be moved to the first position to engage the hang tag 14 with the lid 16.

Figure 4:
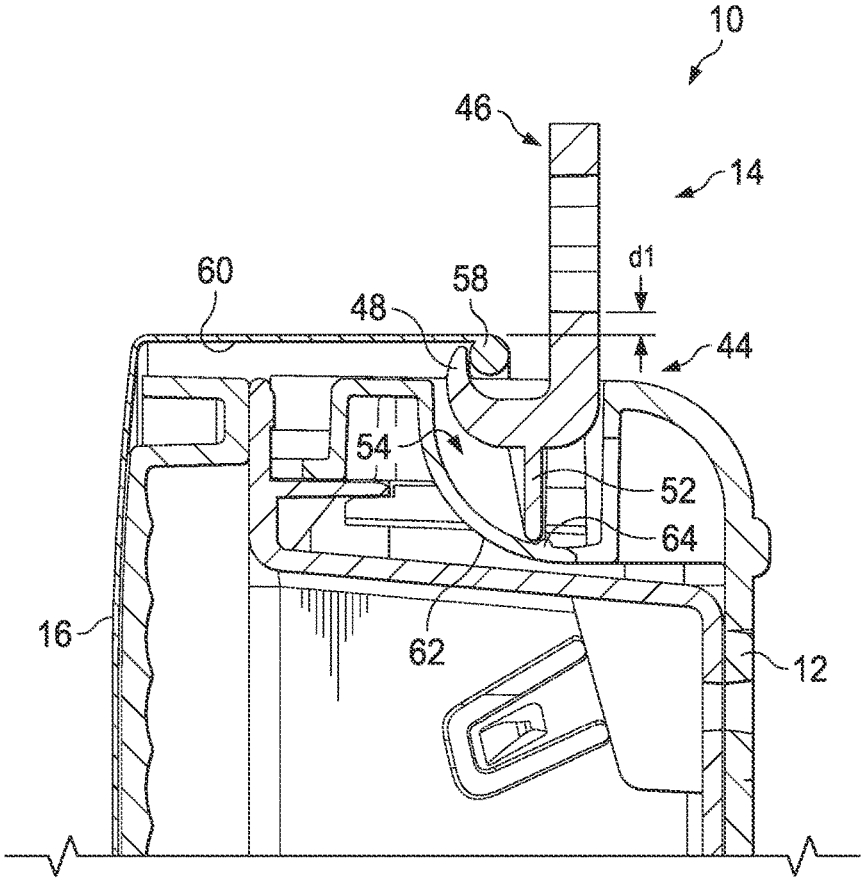
FIG. 4 is a cross section view of the storage and display assembly, taken generally along the line 4-4 of FIG. 1

Referring to FIG. 4, a cross section view of the storage and display assembly 10 is shown in the first position, taken generally along the line 4-4 of FIG. 1. The security tag 20 of FIG. 1 has been removed for clarity. In the first position, the first end 44 of the hang tag 14 may be positioned within the recess 54 of the base 12 and the second end 46 of the hang tag 14 may be positioned outside of the recess 54. The hang tag 14 may engage the lid 16 to secure the lid 16 to the base 12. For example, the lid 16 may have a rim 58 on an inside surface 60 of the lid 16 that the hook 48 engages in the first position securing the lid 16 to the base. Once the securing tag 20 of FIG. 1 is removed, the consumer may move the hang tag 14 out of the first position by pivoting the hang tag 14 to disengage the hook 48 from the lid 16. The recess 54 may have a lower surface 62 that supports the tab 52 in the first position. In certain embodiments, the lower surface 62 may be concave to support the tab 52 as the hang tag 14 pivots within the recess 54. The lower surface 62 may have a protrusion 64 that helps retain the hang tag 14 in the first position. For example, force must be applied to the hang tag 14 for the tab 52 to move past the protrusion 64, thus allowing the hang tag 14 to be moved out of the first position to unlock the lid 16 from the base 12.

Figure 6:
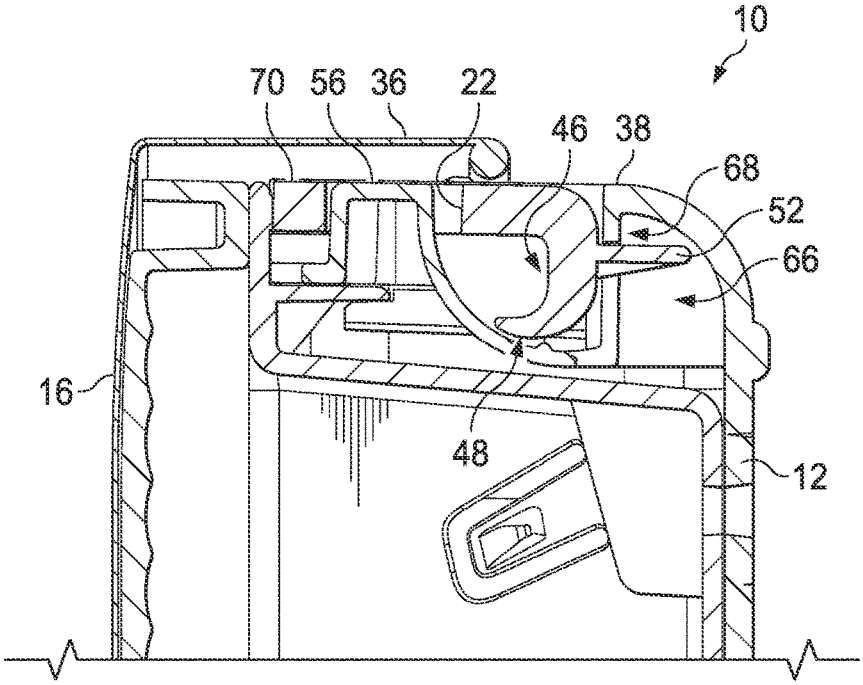
FIG. 6 is a cross section view of the storage and display assembly, taken generally along the line 6-6 of FIG. 5.
Figure 5:
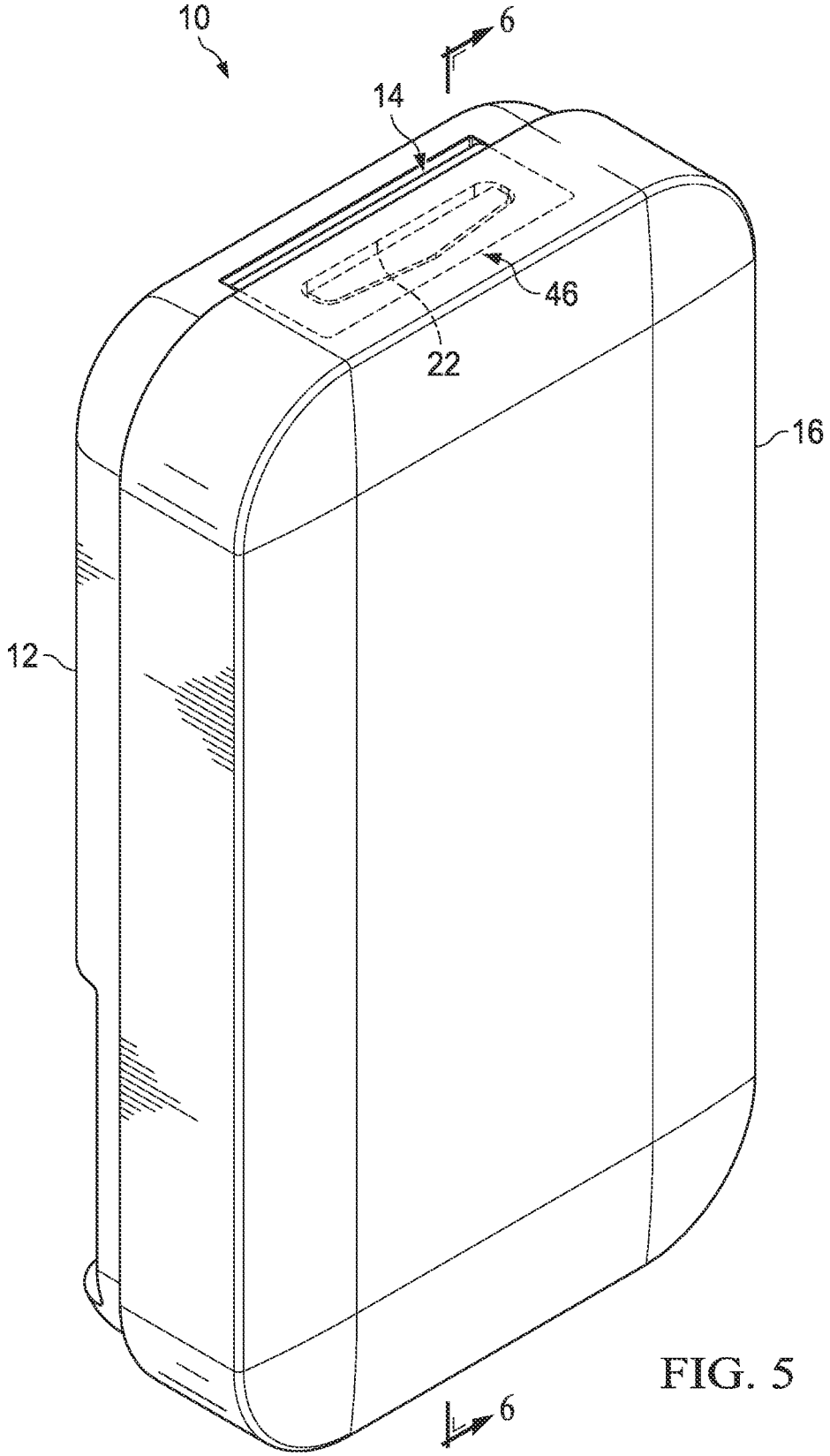
FIG. 5 is a perspective view of the storage and display assembly of FIG. 3 with a hang tag in a second position.

Referring to FIGS. 5 and 6, the storage and display assembly 10 is illustrated with the hang tag 14 in the second position. The second position may be transverse to the first position, with the hook 48 disengaged from the lid 16. Once the hook 48 is disengaged from the lid 16, the lid 16 may be separated from the base 12. The hang tag 14 may then be folded into the second position. In the second position, the second end 46 of the hang tag 14 may be completely positioned within the recess 54 of the base 12. For example, the hang tag 14 may not extend outside of the base 12, thus allowing the lid 16 to be mounted over the base 12 and the hang tag 14. In certain embodiments, the lid 16 may cover the second end 46 of the hang tag 14, thus concealing it from view. The opening 22 of the hang tag 14 may be dimensioned to receive the protrusion 56 extending within the recess 22 of the base. In certain embodiments, the protrusion 56 may engage the recess 22 to help secure the hang tag 14 within the recess 22. As the hang tag 14 is pivoted into the second position, the tab 52 may move over the protrusion 64 of the lower surface 62 and into a second opening 66 that is in communication with the opening 54 of the base 12. The base 12 may have an inner surface 68 that acts as a stop to prevent the hang tag 14 from pivoting too far. For example, a top surface 70 of the second end 46 may be parallel to the top surface 36 of the lid and/or the top surface 38 of the base 12, thus allowing the lid 16 to be easily mounted over the base 12 in the second position. The consumer may use the storage and display assembly 10 as a travel case. The hang tag 14 may also facilitate the storage and display assembly 10 to be hung on a shower hook or from any other type of fixture to provide safe and convenient access.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A storage and display assembly comprising:
a base defining a cavity configured to receive a product;
a lid mounted to the base covering the cavity;
a hang tag mounted to the base, the hang tag having a first position wherein a first end of the hang tag engages an inner surface of the lid securing the lid to the base and a second position wherein the first end of the hang tag is disengaged from the inner surface of the lid; and
a second end of the hang tag is positioned within the recess in the second position.

2. The storage and display assembly of claim 1 wherein the base defines a recess and the first end of the hang tag is secured within the recess in the first position.

3. The storage and display assembly of claim 2 wherein the second end of the hang tag is positioned outside the recess in the first position.

4. The storage and display assembly of claim 1 wherein the lid covers the second end of the hang tag in the second position.

5. The storage and display assembly of claim 1 wherein the first end of the hang tag comprises a hook.

6. The storage and display assembly of claim 1 wherein the hang tag defines an opening between the first end and the second end.

7. The storage display of claim 5 wherein hang tag has a tab extending from a lower surface of the hook.

8. The storage and display assembly of claim 1 wherein hang tag is pivotally mounted to the base.

9. The storage and display assembly of claim 1 wherein the base has a protrusion positioned within the recess.

10. The storage and display assembly of claim 9 wherein in the second position, the protrusion is positioned within an opening defined by the hang tag.

11. The storage and display assembly of claim 1 further comprising removable sleeve positioned around the lid and the base.

12. A storage and display assembly comprising:
a base defining a cavity;
a product positioned within the cavity;
a lid mounted to the base covering the cavity;
a hang tag pivotally mounted to the base, the hang tag having a first position locking the lid to the base and a second position allowing the lid to be removed from the base, wherein the base defines a recess having a lower surface contacting the hang tag in the first position.

13. The storage and display assembly of claim 12 further comprising a security tag secured to the hang tag locking the hang tag in the first position.

14. The storage and display assembly of claim 13 wherein the security tag defines an opening dimensioned to receive a retail peg.

15. The storage and display assembly of claim 12 wherein the lower surface has a protrusion contacting a tab extending from the hang tag.

16. A method of assembling a storage and display assembly comprising:
providing a base defining a cavity;
pivotably attaching a hang tag to the base;
positioning a consumer product within the cavity;
mounting a lid over the base;
covering a portion of the hang tag with the lid; and
pivoting the hang tag to a first position, wherein said pivoting comprises engaging the lid with a hook at a first end of the hang tag.

17. The method of claim 16 further comprising locking the hang tag in the first position by securing a security tag to the hang tag.

* * * * *